US006581432B1

(12) United States Patent
Rut

(10) Patent No.: US 6,581,432 B1
(45) Date of Patent: Jun. 24, 2003

(54) UPSETTING DEVICE

(75) Inventor: Tadeusz Rut, Poznań (PL)

(73) Assignee: Instytut Obrobki Plastycznej, Poznan (PL)

( * ) Notice: Subject to any disclaimer, the term of this patent is extended or adjusted under 35 U.S.C. 154(b) by 0 days.

(21) Appl. No.: 09/890,988

(22) PCT Filed: Feb. 22, 2000

(86) PCT No.: PCT/PL00/00013

§ 371 (c)(1),
(2), (4) Date: Aug. 8, 2001

(87) PCT Pub. No.: WO00/53402

PCT Pub. Date: Sep. 14, 2000

(30) Foreign Application Priority Data

Mar. 5, 1999 (PL) ..... 331813

(51) Int. Cl.[7] ..... B21J 13/02
(52) U.S. Cl. ..... 72/357; 72/451
(58) Field of Search ..... 72/357, 353.2, 72/399, 400, 401, 450, 451

(56) References Cited

U.S. PATENT DOCUMENTS 2,189,573 A * 2/1940 Wegner ..... 72/451
3,348,407 A 10/1967 Rut ..... 72/450
4,646,551 A 3/1987 Rut ..... 72/305

FOREIGN PATENT DOCUMENTS

JP 06047476 2/1994

OTHER PUBLICATIONS

Patent Abstracts of Japan No. 06047476 Feb. 22, 1994.

* cited by examiner

*Primary Examiner*—Lowell A. Larson
(74) *Attorney, Agent, or Firm*—Ladas & Parry

(57) ABSTRACT

A device for upsetting a workpiece has a frame, a head for movement in a first direction toward the frame, and first and second tool holders between the frame and the head for holding dies for the upsetting. A parallelogram linkage mechanism supports the first tool holder on one of the frame and head for movement by the movement of the head in the first direction and in a second direction perpendicular to the first direction and toward the second tool holder for the upsetting. The parallelogram linkage mechanism has first and second pins respectively on the first tool holder and the one of the frame and head, and a link rotatably on the pins, one of the pins being eccentric in the second direction.

21 Claims, 4 Drawing Sheets

UPSETTING DEVICE

BACKGROUND OF THE INVENTION

The invention is a device for upsetting, especially on presses, consisting of two rigid structures, one of which forms the frame, the other the head of the device, and of at least one split tool holder containing die inserts clamping the workpiece and upsetting it in the upsetting zone, located in front of the face of the split dies. One side of the split die holder is slidingly supported by one of the rigid structures in a plane parallel to the split die parting plane while the other side is supported by the parallelogram linkage mechanism, made of at least two toggles which mechanism is, in turn, supported by the other rigid structure of the device. The toggles are kinematically coupled to links, borne on both ends, maintaining the assumed distance of the axes of the two joints of each toggle.

Structures of this kind are known, e.g. from the Polish patent description no. 123785 or U.S. Pat. No. 3,348,407.

They enable conversion of the vertical force of the press slide or other mover to the horizontal force upsetting the workpiece while the vertical component of the press force results in self clamping the workpiece in the split dies. The device reveals the following drawbacks:

1. It has too big overall dimensions in relation to the forged products. The drawback is a result of the way the toggles and links which join them are borne. The links are mounted on the axes of the toggle joints, which increases the width of the device.
2. In order to disassemble even one toot holder, the longitudinal beams of the frame have to be disassembled.
3. The bearing plays of the links cannot be adjusted.
4. The force clamping the material in the dies is equal to half the press force. Such clamping system has the drawback that the material clamping force is a function of the upsetting resistance and, due to the changing inclination angle of the toggles during the working stroke, the value of the ratio of the clamping force to the upsetting resistance is also reduced. The largest forces moving the dies apart arise at the end of forming the product in the die impression. As a result of the force of the deformed metal in the die impression, the die expanding force can exceed the clamping one if this is the case, the transverse dimension of the workpiece increases and a gap between the die inserts in their parting plane is formed.
5. During upsetting, the deformed material moves together with the tool holder. The motion is complex along an arc path. When long rods are forged, this is a significant difficulty due to the inertia forces. Moreover, due to the quick movements of the upset material, the operator c cannot hold it, e.g. in tongs. This complicates handling of the rod when putting it to the subsequent die impression. The result is longer forging time, excessive heating of the tools and, consequently, deterioration of their durability.
6. When the tool holders are put together in the working stroke, they bump each other in the parting plane causing noise and undesirable stresses in some design nodes of the device, which can lead to its damage.

SUMMARY OF THE INVENTION

The objective of the invention is to eliminate those inconveniences. In accordance with the invention, the objective has been obtained thanks to the fact that each link has two separate bearing pins one of which is installed on the tool holder supported on the parallelogram linkage mechanism, the other is installed on the rigid structure on which the parallelogram linkage mechanism is supported.

Adjustability of one of the bearing pins is advisable.

In some cases, it is advantageous for the adjustable beating pin to be installed on the longitudinal beam of the frame.

In another alternative, it is advantageous to install the adjustable bearing pin on the head of the device.

It is advantageous, if the adjustable bearing pin is seated on an eccentric provided with position securing blockade.

In order to eliminate the undesirable vibration and noise, it is advisable to provide the tool holders with oblique bumpers facing the elastic ones located in one of the rigid structures.

As an alternative, elastic bumpers can be installed in the tool holder to face the oblique bumpers located in one of the rigid structures.

In order to prevent the split dies going apart during working stroke, it is advantageous, if the tool holder containing the die insert with the forming impression and supported on the parallelogram linkage mechanism, is slidably supported on a console, i.e. sole, perpendicular to the head motion and parallel to the upsetting direction, which console is rigidly connected to the oppositely working tool holder supported on the other parallelogram linkage mechanism.

In another possible solution, in order to prevent the split dies going apart during the working stroke, the tool holder supported on the parallelogram linkage mechanism, is slidably supported on at least one console perpendicular to the head motion and parallel to the upsetting direction which console is rigidly connected with a punch slider slidably seated on a guide parallel to the head motion.

It is advantageous, if at least one of its tool holders supported on the parallelogram linkage mechanism is provided with a die insert holder slider with which it is slidably connected in the direction perpendicular to the head motion and parallel to the upsetting direction, the die insert holder slider being immovable in the direction perpendicular to the head motion.

In another possible solution, the tool holder supported on the parallelogram linkage mechanism has a projection to couple it with a punch slider slidable in the direction perpendicular to the press slider motion.

Another design solution is possible, too, in which the tool holders supported on the parallelogram linkage mechanism situated on one side of the die parting plane are connected to those on the other side of the plane by means of columns arranged parallel to the direction of the head motion and the tool holders supported on the parallelogram linkage mechanisms are equipped with pulling back mechanisms.

BRIEF DESCRIPTION OF THE DRAWINGS

The invention is explained below on four examples of execution presented in the drawing, where.

DESCRIPTION OF THE PREFERRED EMBODIMENTS

Figure 1:
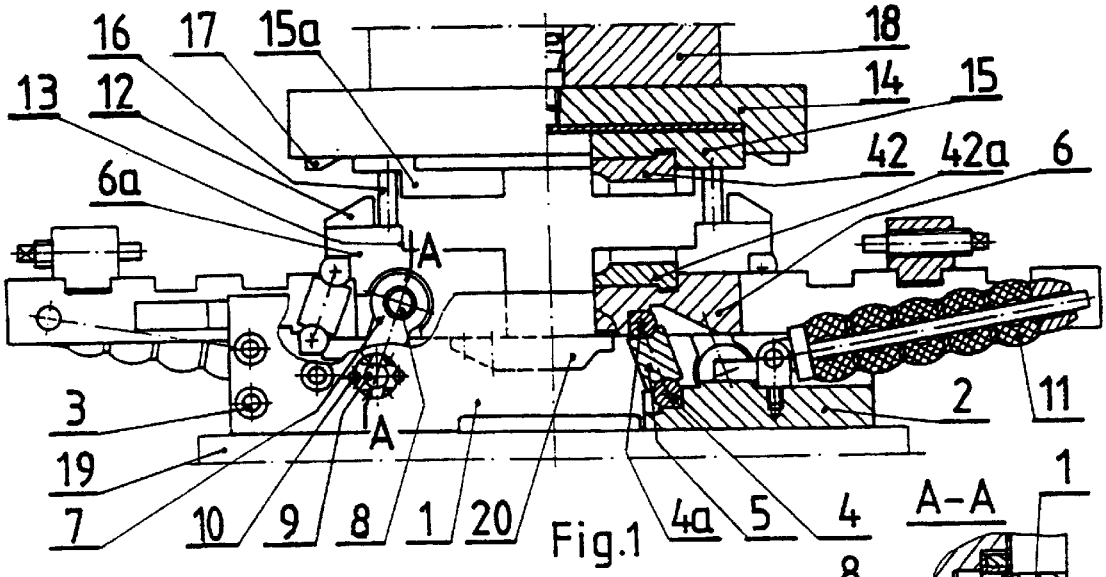
FIG. 1 shows the first example of the device installed on a press in the open position (left side in a side view, right one in a longitudinal section), FIG. 2—the device in a cross section along the A—A line in FIG. 1, FIG. 3—the device at the moment of the oblique bumpers' contact in a side view, FIG. 4—the device at the bottom position of the press slider in a side view, partially a section, FIG. 5—the second example of the device execution with the slider in its upper position, shown in the longitudinal section, FIG. 6—the device as per FIG. 5, at the moment of the oblique bumpers' contact in a side view, partially as a section, FIG. 7—the device as per FIG. 5 with the press slider in its lower position, in a side view, partially as a section.
Figure 2:
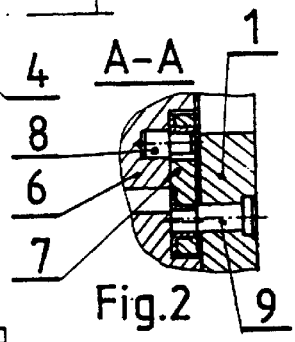
Figure 3:
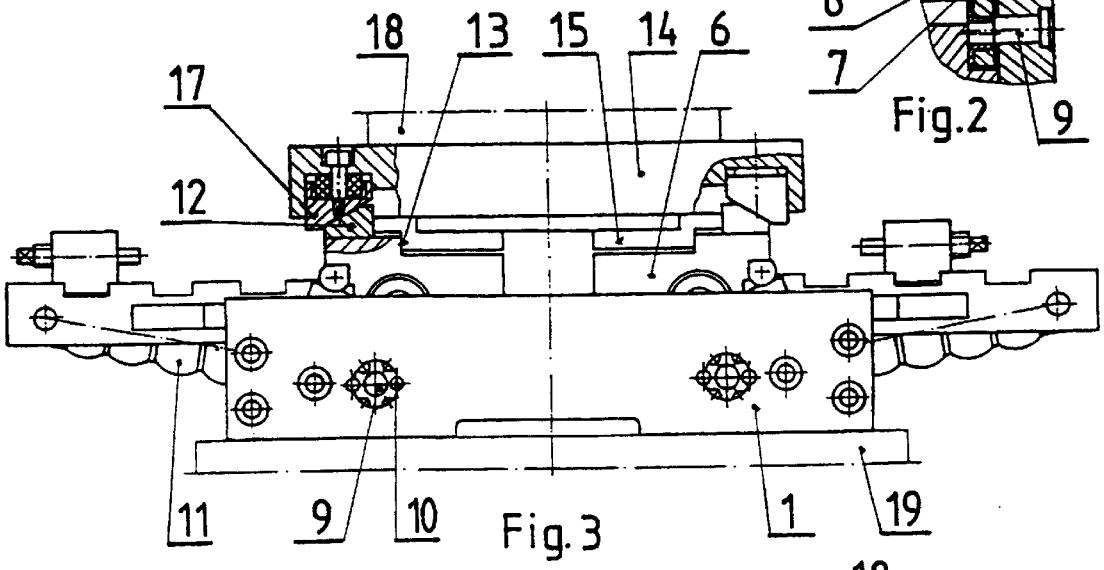
Figure 4:
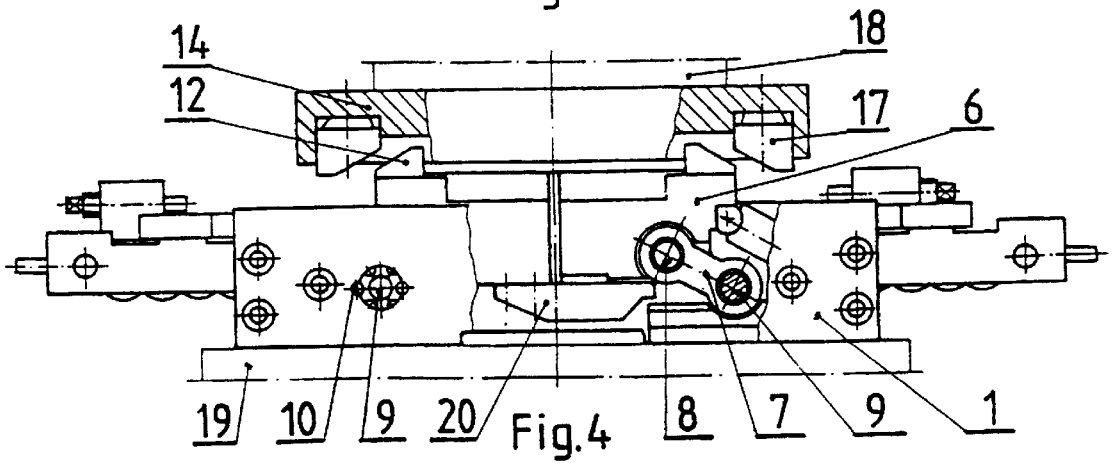

In the first example of the execution, shown in FIGS. 1 to 4, the device consists of two units, the bottom one and the top one. The bottom unit has a frame formed by two longitudinal beams, 1, with lateral beams, 2, arranged between them. The frame is screwed together by means of bolts, 3. On the lateral beams, 2, bearing shafts, 4, are installed, on which toggles, 5, are supported. The bottom and top surfaces of the toggles are concave-cylindrical. The top concave surfaces of the toggles abut to the bearing shafts, 4*a*, which, in turn, are fastened to the tool (die) holders, 6 and 6*a*. The toggle, 5, together with their bearing shafts, 4, and tool holders form two parallelogram linkage systems. The toggles of both those mechanisms are inclined to each other in pairs so that during the operation of the device, the tool holders move towards each other. The bearing shafts assigned to one of the toggles are not tacked together by means of links as described, for instance, in the Polish patent description no. 123785. In this invention, links, 7, have been applied, each of which is borne on two separate pins, 8 and 9. The upper pin is rigidly seated in tool holder, 6, the lower one is adjustable (FIG. 2).

It is turnably mounted in the longitudinal beam, 1, and has an eccentric front part forming rotation axis for the link, 7. The desired position of the eccentrics can be secured by means of bolts, 10, accessible from the outer side of the longitudinal beams, 1. The tool holders, 6, are connected to elastomer pulling back mechanisms, 11, and are provided with oblique bumpers, 12.

The top unit of the device consists of a head plate, 14, to which two upper tool holders, 15 and 15*a*, are slidably fastened which holders are coupled to the lower tool holders, 6 and 6*a*, by means of columns 16. The columns are rigidly secured to the holders, 15 and 15*a*, while their bottom ends are slidingly seated in the holes made in the lower holders, 6 and 6*a*. On the bottom surface of the bottom left tool holder, 6*a*, there is a console, 20, rigidly secured to it protruding to the right beyond the vertical symmetry plane of the device and slidingly supporting the underside of the bottom right tool holder, 6.

The device functions in the following way:

When the device is open, heated material to be forged is placed on the bottom parts of the die inserts, 42*a*, seated in holders, 6 and 6*a*, after which the press is started. During the working stroke of the press, first the bumpers, 12 and 17, get in contact; they damp the contact of the die holders, 6, to 6*a* and 15 to 15*a*.Then, the upper tool holders, 15 and 15*a*, containing the top parts of the die inserts, 42, press the lower tool holders, 6 and 6*a*. The material is clamped in the dies. Thanks to the toggles, 5, whose top parts are deflected from vertical towards the vertical symmetry plane and to the sliding seating of the holders, 15 and 15*a*, the left and right dies move towards each other in the horizontal direction and the part of material between them is upset. During material forming, when the force parting the dies increases to exceed the force clamping them, console, 20, supporting the holder in which the dies are mounted, boosts the die clamping and, consequently, prevents excessive formation of undesirable flash.

Once the press slider is withdrawn, the pulling back mechanism bring the parallelogram linkage mechanisms back to their initial position in which the forging is removed from the dies.

The tool holder supported on the parallelogram linkage mechanism has a projection 13 to couple it with a punch slider slidable in the direction perpendicular to the press slider motion.

Figure 5:
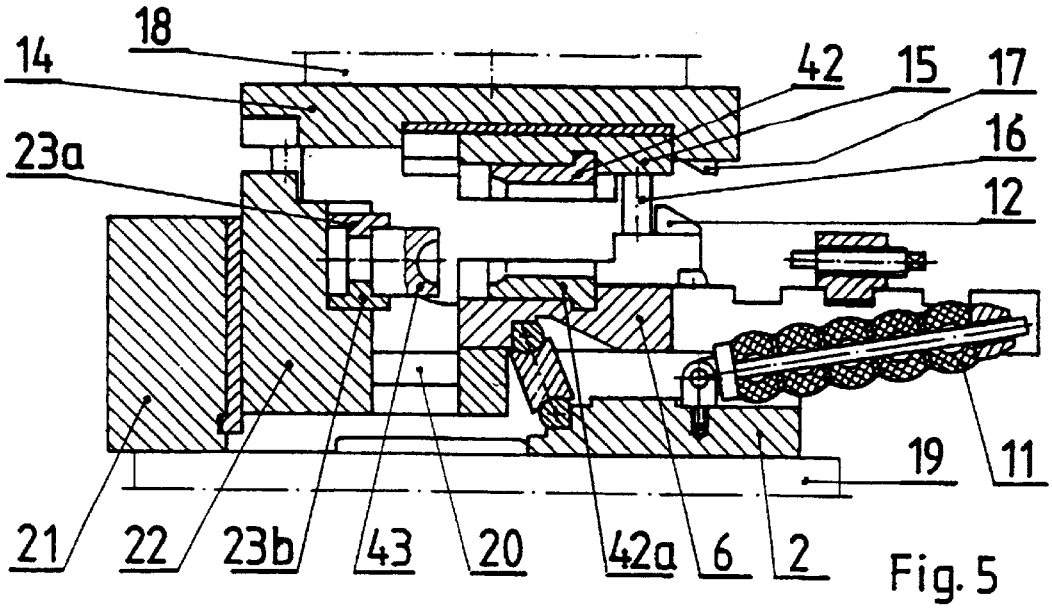
Figure 6:
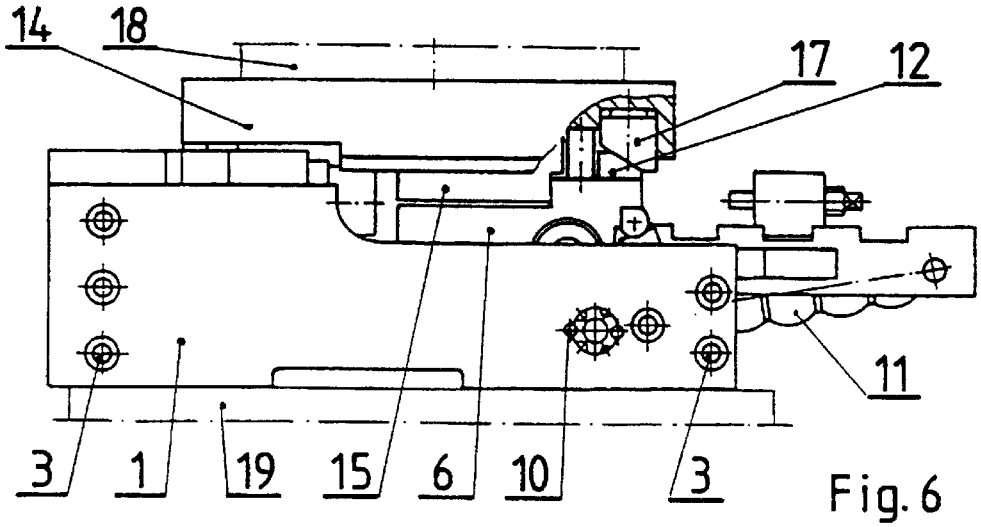
Figure 7:
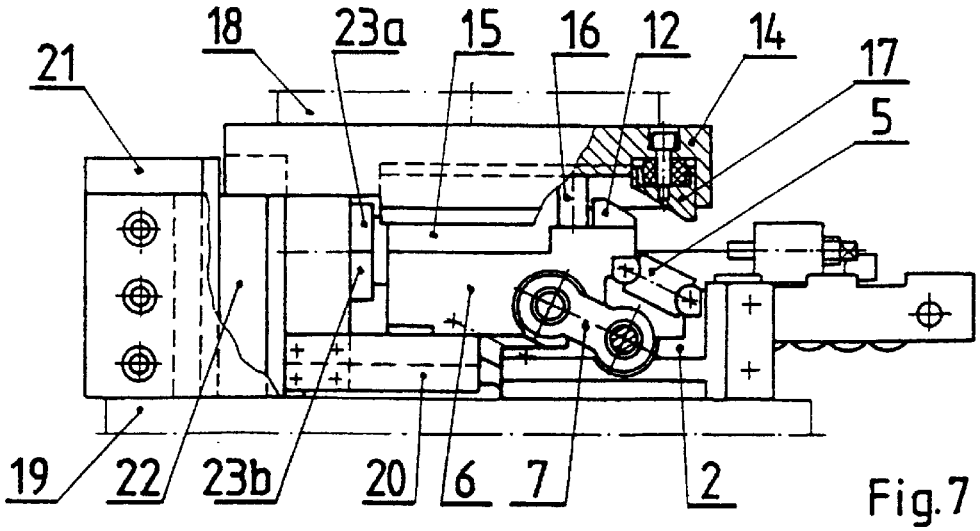

In the second example, presented in FIGS. 5 to 7, only one bottom tool holder, 6, supported on the parallelogram mechanism, has been applied (the right one in the drawing) which is coupled to the top tool holder, 15, slidingly seated in the head, by means of columns, 16, like in the case described above. The design of the link, 7, tacking the joints and toggles of the- parallelogram linkage system, has also been solved in the same way. Similar to the device shown in FIGS. 1 to 4, oblique bumpers, 12 and 17, have been applied. The left part of the device has a different design. In this case, the cross beam slide, 21, has a punch slider, 22, fastened to it slidingly (in the vertical direction) with punch holders, 23*a* and 23*b*.

This device functions as follows:

When the device is open, punch 43 is mounted in the punch holders, 23*a* and 23*b*. The heated material to be forged is placed on the bottom parts of the die inserts, 42*a*, seated in holder 6. After that the press is started. During the working stroke, bumpers 12 and 7 come in contact first, damping the impact of the tool holders; then, the top tool holder, 15, containing the upper part of the die insert, 42, presses the lower tool holder, 6. The workpiece is clamped in the dies. Thanks to the toggles, 5, whose top parts are deflected from vertical towards the punch slider, 22, the holder, 6, and the die approach the punch slider, 22, in the horizontal direction and, consequently, the punch, 43, contained in holders 23*a* and 23*b*, forms the end of the hot material clamped in the dies. The console, 20, has also been applied in the device; in this case, however, it is fastened to the punch slider, 22, and it prevents the dies' moving apart during the working stroke. Once the press slider is withdrawn, the pulling back mechanism brings the parallelogram linkage system back to its initial position in which the forging is removed from the dies.

Figure 8:
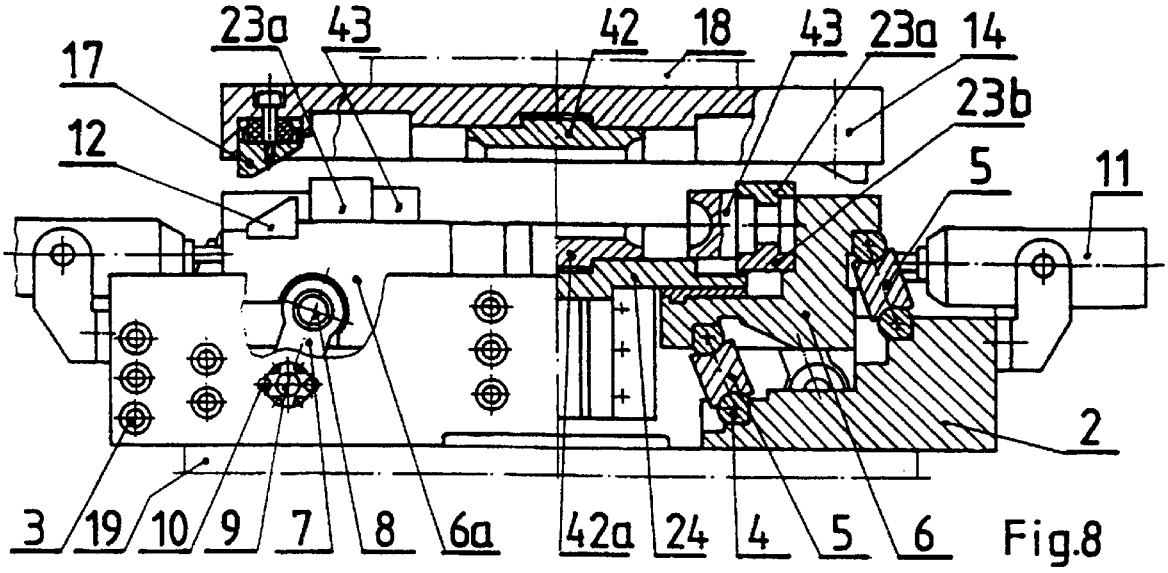
FIG. 8 shows the third example of the device execution with the press slider in its upper position in a side view, partially as a section, FIG. 9—the bottom part of the device as per FIG. 8 with the tools removed, in a top view, FIG. 10—the device as per FIG. 8 with the bottom dead center position of the press slider in a side view, partially as a section.
Figure 9:
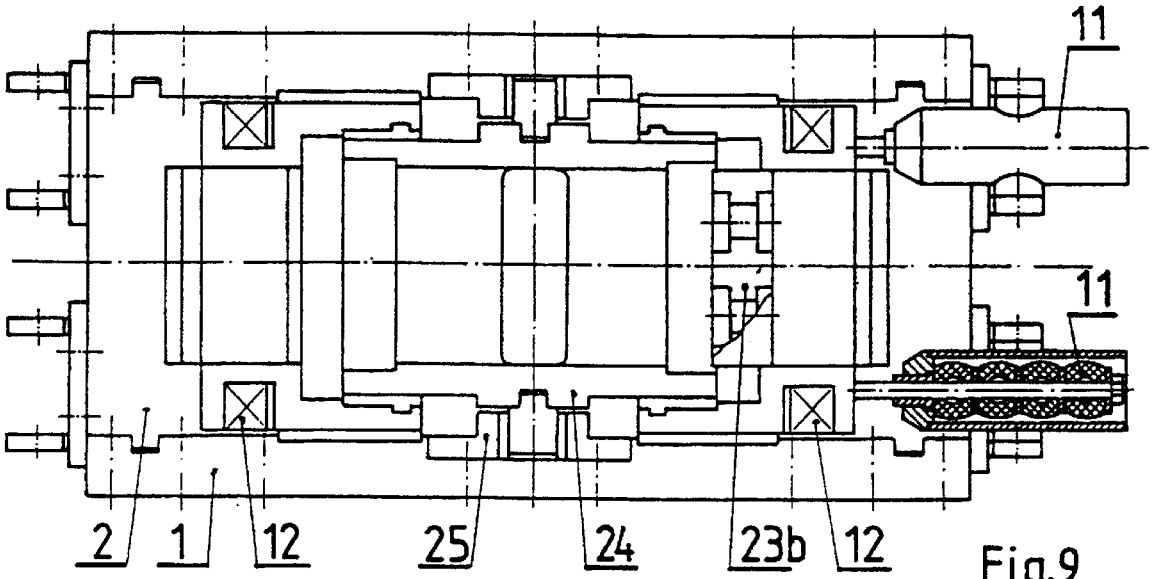
Figure 10:
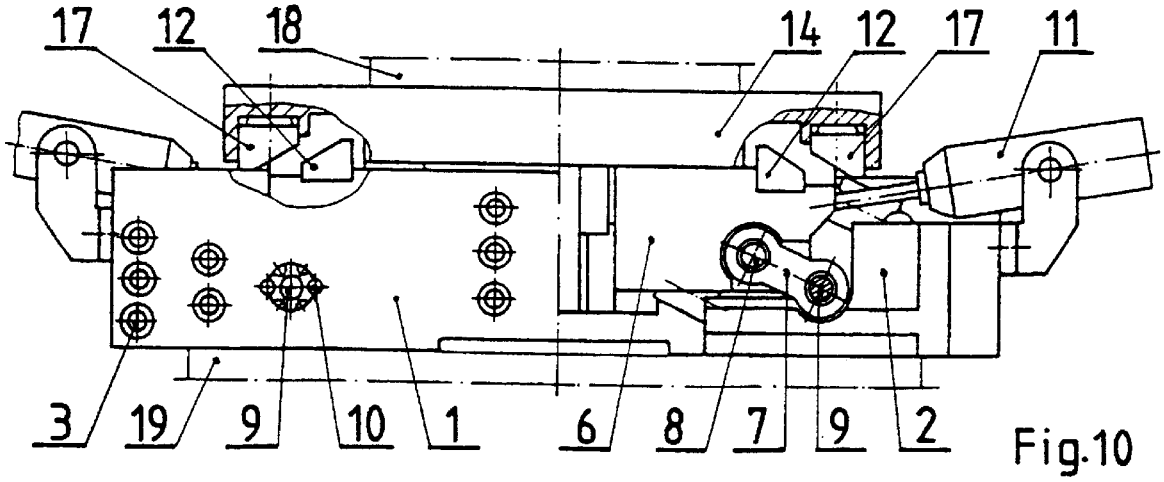

In the third example, presented in FIGS. 8 to 10, like in the design as per FIGS. 1 to 4, two parallelogram linkage systems have been used. In this case, however, the punch holders, 23*a* and 23*b*, are seated in the toot holders, 6 and 6*a*.

Additionally, a die insert holder slider, 24, has been installed in the middle part of the device. The slider is slidingly supported on the tool holders, 6 and 6*a*, and fastened to the frame, on which it can slide in the vertical direction, by means of guides, 25. The holder slider, 24, is provided with an impression for mounting the die insert, 42, there is a similar impression in the head plate, 14.

The device functions as follows:

Punches, 43, are mounted in the die holders, 23*a* and 23*b*, while split die inserts, 42, are installed in the holder slider and in the head plate. When the device is open, the material to be forged is placed on the die inserts installed in the impression of the holder slider, 24.

When the press is started, the bumpers, 12 and 17, come in contact, damping the impact of the tool holders, 6 and 6*a*, against the head plate, 14. Then the heated material is clamped in the dies seated in the impressions of the head plate, 14, and in the holder slider, 24. Thanks to the toggles, 5, the left and right tool holders, 6 and 6*a*, move towards each other. The punches mounted in the holders, 23*a* and 23*b*, upset both ends of the workpiece. After the press slider withdraws, the pulling back mechanisms bring the tool holders to their initial position in which the workpiece is removed or placed in a subsequent set of die impressions installed in the device.

Figure 11:
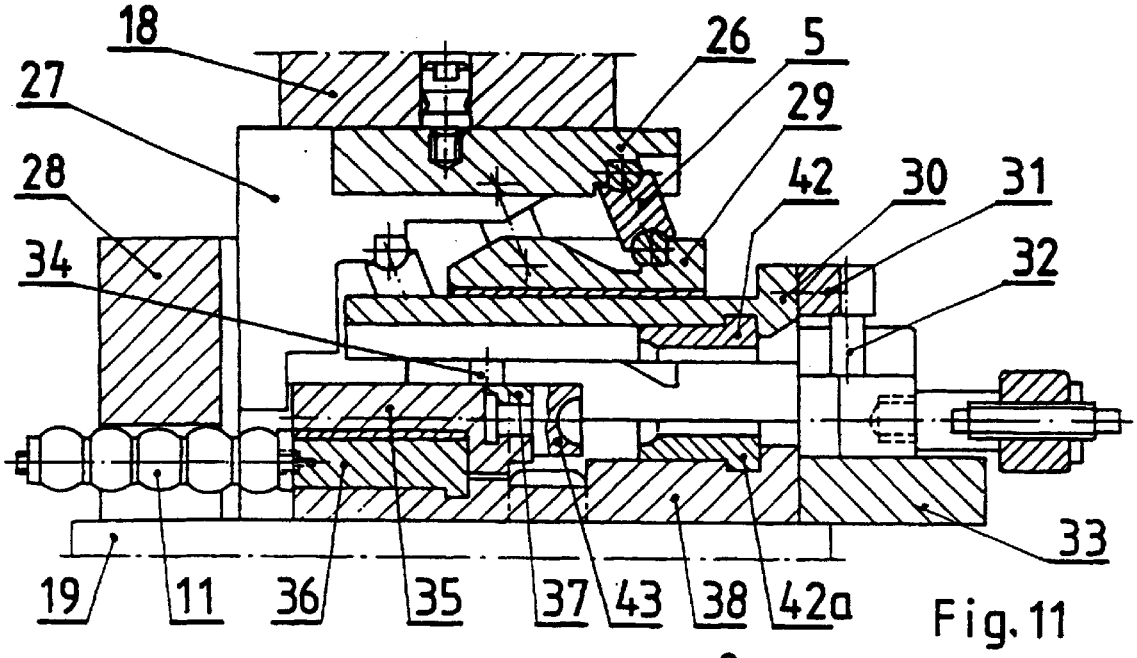
FIG. 11 shows the fourth example of the device execution with the press slider in its upper position, as a longitudinal section, FIG. 12—the device as per FIG. 11 prior to the working stroke (tool holders are closed), in a side view, with the longitudinal beam removed, partially as a section, FIG. 13—the device as per FIG. 11 at the end of the working stroke, i.e. at the end of the upsetting operation, in a side view, partially as a section.
Figure 12:
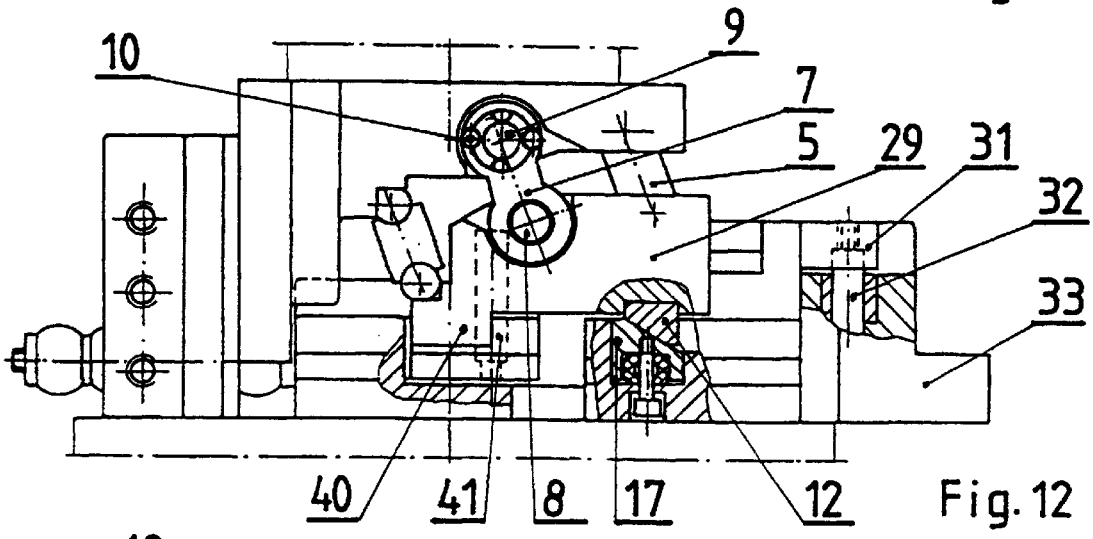
Figure 13:
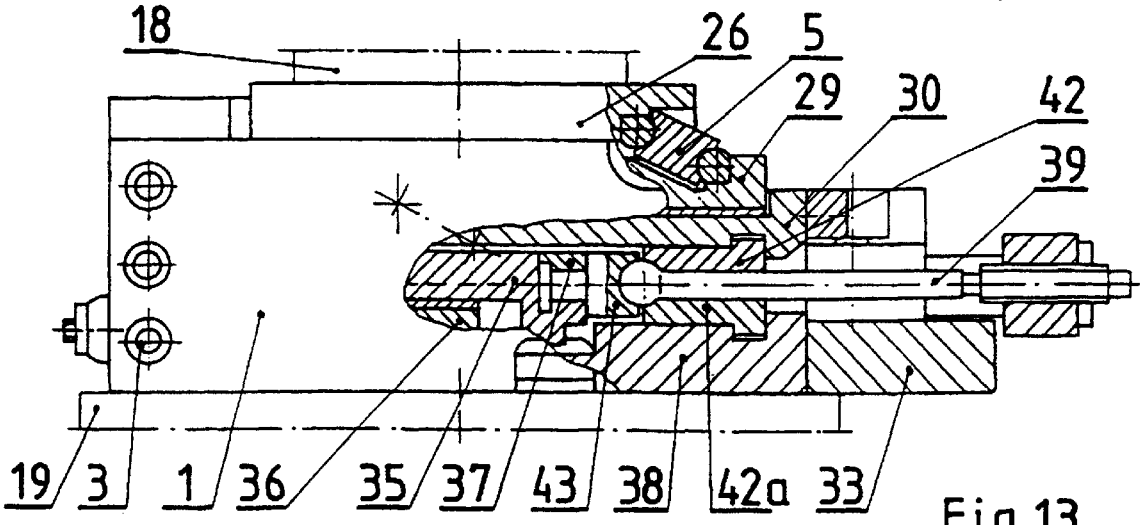

In the fourth example, shown in FIGS. 11 to 13, only one parallelogram linkage system has been applied. Its design is similar to the ones described above; it differs from them in that it is installed on the head part of the device. The head, 26, is provided with vertical guides, 27, which are slidingly mounted in the cross beam, 28, of the frame. On the head, 26, the parallelogram linkage system is suspended which comprises the toggles, 5, and the tool holder, 29, coupled with them, which holder is, in turn, slidingly connected with the top holder of the top die, 42. The right front surface of the top holder, 30, rests on the shackle, 31, connected with the cross beam of the frame, 33, by means of the vertical column, 32. The top holder, 29, is coupled to the punch slider, 35, by means of the vertical column, 34. The slider is horizontally slidable on the guide, 36, rigidly secured in the frame. In the punch slider, 35, a punch holder, 37, is installed. The bottom tool holder, 38, is rigidly mounted, in the frame of the device.

The device is provided with pulling back mechanisms to bring its sub-units to their initial position after each working stroke. In the lower part of the top tool holder, 29, oblique bumpers, 12, are installed, while elastic bumpers, 17, are mounted in the bottom tool holder, 38.

The device is particularly suitable for mounting in mechanical presses, with its bottom part fastened to the press table and the head to the press slider.

The device functions as follows:

When it is open (i.e. in the condition shown in FIG. 11), punches, 43, are installed in the holders, 37. Bottom die inserts are installed in the bottom tool holder, 38. In the top tool holder, 30, top die inserts, 42, are installed. The heated material to be forged is placed in the impression of the bottom die inserts, 42*a*. During the working stroke, first the bumpers, 12 and 17, come in contact, damping the impact of the tool holders getting together. Then the top tool holder, 29, presses the bottom tool holder, 38. The material is clamped in the dies which are motionless during the working stroke. Thanks to the toggles, 5, whose upper parts are deflected towards the shackle, 31, the top tool holder, 29, is pressed downward and to the right, sliding horizontally to the right along the top holder, 30. Thanks to the projections, 40, on the top tool holder engaging the projection, 41, on the punch slider, 35, the slider is moved to the right causing upsetting of the left end of the material. When the press slider withdraws, the pulling back mechanism, 11, brings the punch slider, 35, to its initial position. Due to the action of the column, 34, the top tool holder and the parallelogram linkage mechanism connected with it are also withdrawn to the initial position. The forging, 39, can now be removed or put to the next die impression.

Such a solution has two important advantages. One of them is the possibility to generate an upsetting force exceeding the press capacity. The other is that the material and the dies clamping it are motionless during the working stroke, which allows energy saving and significantly facilitates material handling during forging.

What is claimed is:

1. In a device for upsetting a workpiece, the device having a frame, a head for movement in a first direction toward the frame, first and second tool holders between the frame and the head for holding dies for the upsetting, and a parallelogram linkage mechanism supporting the first tool holder on one of the frame and head for movement by the movement of the head in the first direction and in a second direction perpendicular to the first direction and toward the second tool holder for the upsetting, the improvements wherein:

the parallelogram linkage mechanism comprises first and second pins respectively on the first tool holder and the one of the frame and head, and a link rotatably on the pins, wherein one of the pins is eccentric in the second direction.

2. The device according to claim 1, and further comprising elastic and oblique bumpers on the tool holders responsive to the movement of the head in the first direction for urging the movement of the first tool holder in the second direction in response to the movement in the first direction before the movement by the parallelogram linkage mechanism.

3. The device according to claim 1, wherein the first tool holder is split into first and second elements, the first element having a sole moveable with the first element in the second direction against the second element for supporting the second element for the movement of the first tool holder in the first direction only with the first element.

4. The device according to claim 2, wherein the first tool holder is split into first and second elements, the first element having a sole moveable with the first element in the second direction against the second element for supporting the second element for the movement of the first tool holder in the first direction only with the first element.

5. The device according to claim 1, and further comprising means for sliding one of the tool holders on one of the frame and head in the second direction in response to the movement of the first tool holder in the second direction.

6. The device according to claim 4, and further comprising means for sliding one of the tool holders on one of the frame and head in the second direction in response to the movement of the first tool holder in the second direction.

7. The device according to claim 1, wherein one of the first and second tool holders has a projection for engaging the other of the first and second tool holders and moving the second tool holder with the first tool holder in the second direction.

8. The device according to claim 2, wherein one of the first and second tool holders has a projection for engaging the other of the first and second tool holders and moving the second tool holder with the first tool holder in the second direction.

9. The device according to claim 3, wherein one of the first and second tool holders has a projection for engaging the other of the first and second tool holders and moving the second tool holder with the first tool holder in the second direction.

10. The device according to claim 4, wherein one of the first and second tool holders has a projection for engaging the other of the first and second tool holders and moving the second tool holder with the first tool holder in the second direction.

11. The device according to claim 7, wherein the projection is a column extending from the second tool holder into a hole in the first tool holder.

12. The device according to claim 10, wherein the projection is a column extending from the second tool holder into a hole in the first tool holder.

13. In a device for upsetting, especially on presses, consisting of:

two rigid structures, one of which form the frame,—the other head of the device, and of at least one split tool holder containing die inserts clamping the workpiece and upsetting it in the upsetting zone, located in front of the face of the split dies, one side of the split die holder being slidingly supported by one of the rigid structures in a plane parallel to the split die parting plane, while the other side is supported by the parallelogram linkage mechanism, made of at least two toggles which mechanism is, in turn, supported by the other rigid structure of the device, the toggles being kinematically coupled to links maintaining the assumed distance of the axes of two joints of each toggle by means of a links which have two separate bearing pins one of which is adjustable eccenter bearing pin seated in the rigid structure of the device and the second bearing pin is seated into the die holder supported on the parallelogram linkage mechanism.

14. A device according to claim 13, wherein the oblique bumpers, installed in the tool holders, facing the elastic bumpers, located in one of the rigid structures (14, 38).

15. A device according to claim 13, wherein the elastic bumpers, installed in the tool holders, facing the oblique bumpers, located in one of the rigid structures (14, 38).

16. A device according to claim 13, wherein the tool holder, being supported on the parallelogram linkage and containing a die insert with the forming impression slidably rested on the console, perpendicular to the motion of the head, and parallel to the upsetting direction, which console is rigidly joined to the tool holder, resting on the other parallelogram linkage.

17. A device according to claim 13, wherein the tool holder, supported on the parallelogram linkage mechanism being slidably supported on at least one console, perpendicular to the head motion and parallel to the upsetting direction, which console is rigidly joined to the punch slide, shiftably seated on the guide, parallel to the head motion.

18. A device according to claim 13, wherein at least one of its tool holders, supported on the parallelogram linkage mechanism, being provided with a die insert holder (24) and (30), to which it is connected slidably in the direction perpendicular to the head motion and parallel to the upsetting direction; those holders being immovable in the direction perpendicular to the head motion.

19. A device according to claim 13, wherein at least one tool holder (6), supported on the parallelogram linkage mechanism being provided with a projection (13), to couple it with the tool holder (15), slidable in the direction perpendicular to the head motion.

20. A device according to claim 13, wherein the tool holder (29), supported on the parallelogram linkage mechanism being provided with a projection (40), to , couple it with the punch slide shiftable in the direction perpendicular to the press slide motion.

21. A device according to claim 13, wherein the tool holders (6) and **(6*a*), supported on the parallelogram linkage mechanism on one side of the die parting plane being slidably connected with the tool holders (15) and (15*a*), on the other side of the plane, by means of columns (16), arranged parallel to the head motion and the tool holders (6) and (6*a*)**, supported on the parallelogram linkage mechanism being equipped with pulling back mechanisms.

* * * * *